US009245730B2

(12) United States Patent
Kamdar et al.

(10) Patent No.: US 9,245,730 B2
(45) Date of Patent: Jan. 26, 2016

(54) APPARATUS AND METHODS FOR GENERATING ELECTROMAGNETIC RADIATION

(75) Inventors: Amar B. Kamdar, Burnaby (CA); David Malcolm Camm, Vancouver (CA); Mladen Bumbulovic, Vancouver (CA); Peter Lembesis, Langley (CA)

(73) Assignee: Mattson Technology, Inc., Fremont, CA (US)

( * ) Notice: Subject to any disclaimer, the term of this patent is extended or adjusted under 35 U.S.C. 154(b) by 0 days.

(21) Appl. No.: 14/379,470

(22) PCT Filed: Feb. 24, 2012

(86) PCT No.: PCT/CA2012/000176

§ 371 (c)(1),
(2), (4) Date: Aug. 18, 2014

(87) PCT Pub. No.: WO2013/142942

PCT Pub. Date: Oct. 3, 2013

(65) Prior Publication Data

US 2015/0035436 A1 Feb. 5, 2015

(51) Int. Cl.

| | |
|---|---|
| ***H01J 1/02*** | (2006.01) |
| ***H01J 61/10*** | (2006.01) |
| ***H01J 61/52*** | (2006.01) |
| ***H01J 61/84*** | (2006.01) |

(52) U.S. Cl.

CPC ..... *H01J 61/10* (2013.01); *H01J 61/52* (2013.01); *H01J 61/523* (2013.01); *H01J 61/84* (2013.01)

(58) Field of Classification Search

CPC ..... H01J 61/84; H01J 61/523; H01J 61/10; H01J 61/52

USPC ..... 313/24, 35, 231.31, 231.41, 231.61

See application file for complete search history.

(56) References Cited

U.S. PATENT DOCUMENTS

| | | | |
|---|---|---|---|
| 4,027,185 | A | 5/1977 | Nodwell et al. |
| 4,700,102 | A | 10/1987 | Camm et al. |
| 4,917,785 | A | 4/1990 | Juvan |
| 4,937,490 | A | 6/1990 | Camm et al. |
| 6,621,199 | B1 | 9/2003 | Parfeniuk et al. |
| 6,941,063 | B2 | 9/2005 | Camm et al. |
| 7,781,947 | B2 | 8/2010 | Camm et al. |
| 8,384,274 | B2 | 2/2013 | Camm et al. |
| 2005/0179354 | A1 | 8/2005 | Camm et al. |

OTHER PUBLICATIONS

Heraeus, Heraeus Reflective Coating (HRC®) for Lamp materials, Datasheet, dated Dec. 14, 2009, 2 pages.

Heraeus, OM 100, Datasheet, dated Mar. 12, 2009.

Macor, Corning—Specialty Materials, Datasheet, created Aug. 17, 2001, modified Jul. 11, 2011, 7 pages, USA.

International Search Report of the International Searching Authority completed Oct. 22, 2012 in PCT/CA2012/000176 filed Feb. 24, 2012.

Written Opinion of the International Searching Authority mailed Jul. 11, 2012 in PCT/CA2012/000176 filed Feb. 24, 2012.

*Primary Examiner* — Vip Patel

(74) *Attorney, Agent, or Firm* — Knobbe, Martens, Olson & Bear, LLP

(57) ABSTRACT

An apparatus for generating electromagnetic radiation includes an envelope, a vortex generator configured to generate a vortexing flow of liquid along an inside surface of the envelope, first and second electrodes within the envelope configured to generate a plasma arc therebetween, and an insulative housing associated surrounding at least a portion of an electrical connection to one of the electrodes. The apparatus further includes a shielding system configured to block electromagnetic radiation emitted by the arc to prevent the electromagnetic radiation from striking all inner surfaces of the insulative housing. The apparatus further includes a cooling system configured to cool the shielding system.

37 Claims, 9 Drawing Sheets

APPARATUS AND METHODS FOR GENERATING ELECTROMAGNETIC RADIATION

BACKGROUND

1. Technical Field

The present invention relates to apparatus and methods for generating electromagnetic radiation. More particularly, illustrative embodiments relate to arc lamps having a vortexing flow of liquid along an inside surface of the arc tube or envelope.

2. Description of Related Art

Electric arc lamps are used to produce electromagnetic radiation for a wide variety of purposes. A typical conventional direct current (DC) arc lamp includes two electrodes, namely, a cathode and an anode, mounted within a quartz envelope often referred to as the arc tube. The envelope is filled with an inert gas such as xenon or argon. An electrical power supply is used to sustain a continuous plasma arc between the electrodes. Within the plasma arc, the plasma is heated by the high electrical current to a high temperature via particle collision, and emits electromagnetic radiation, at an intensity corresponding to the electrical current flowing between the electrodes.

The most powerful type of arc lamp is the so-called "water-wall" arc lamp, in which a liquid such as water is circulated through the arc chamber with a tangential velocity so as to form a vortexing liquid wall (the "water wall") flowing along the inside surface of the arc chamber envelope. The vortexing liquid wall cools the periphery of the inert gas column through which the arc is discharged. This cooling effect constricts the arc diameter and gives the arc a positive dynamic impedance. The rapid flow rate of the vortexing liquid wall ensures that this cooling effect is approximately constant over the entire length of the arc discharge, resulting in uniform arc conditions and spatially uniform emission of electromagnetic radiation. A vortexing flow of inert gas is maintained immediately radially inward from the vortexing liquid wall, to stabilize the arc. The vortexing liquid wall efficiently removes heat from the inside surface of the envelope and also absorbs infrared, thus lowering the amount of electromagnetic radiation absorbed by the envelope. The vortexing liquid wall also removes any material evaporated or sputtered by the electrodes, preventing darkening of the envelope. U.S. Pat. No. 4,027,185 to Nodwell et al., which shares overlapping inventorship with the present application, and which is incorporated herein by reference, is believed to disclose the first water-wall arc lamp. Further improvements upon such water-wall arc lamps are disclosed in U.S. Pat. No. 4,700,102 to Camm et al., U.S. Pat. No. 4,937,490 to Camm et al., U.S. Pat. No. 6,621,199 to Parfeniuk et al., U.S. Pat. No. 7,781,947 to Camm et al., and U.S. Patent Application Publication No. 2010/0276611 to Camm et al., all of which share overlapping inventorship with the present application, are commonly owned with the present application, and are incorporated herein by reference.

Due to the above-noted effects of the vortexing liquid wall, such water-wall arc lamps are capable of much higher power fluxes than other types of arc lamps. For example, the above-noted U.S. Pat. No. 4,027,185 to Nodwell et al. discloses and contemplates operation at 140 kilowatts, and subsequent water-wall arc lamps manufactured by the assignee of the present application have been rated for continuous operation at up to 500 kilowatts, and for pulsed or flashed operation at up to 6 megawatts. In contrast, other types of arc lamps are typically an entire order of magnitude less powerful, with continuous outputs typically limited to tens of kilowatts.

Many applications of such high-power water-wall arc lamps only require operation for short periods of time, such as several seconds. For example, in flash-assisted rapid thermal annealing of semiconductor wafers, as disclosed in commonly owned U.S. Pat. No. 6,941,063, an argon plasma water-wall arc lamp may be activated to continuously irradiate a semiconductor wafer for no more than several seconds, to heat the wafer in an approximately isothermal manner from room temperature to an intermediate temperature somewhere in the range between 600° C. and 1250° C., at a ramp rate between 250° C. per second and 400° C. per second. Upon reaching the intermediate temperature, another argon plasma water wall arc lamp is activated to produce an abrupt high-power irradiance flash, which may have a duration of about one millisecond for example, to heat the device side surface to a higher annealing temperature at a ramp rate in excess of 100,000° C. per second. Thus, in each annealing cycle, the water wall arc lamps may be activated for durations ranging from a millisecond to several seconds, with lengthy cooling periods between annealing cycles.

SUMMARY

The present inventors have investigated the continuous operation of water-wall arc lamps for longer periods of time in more challenging conditions than those that were involved in previous typical applications. Such conditions are not believed to have been previously encountered by any other type of arc lamp since other types of arc lamps are not capable of causing such conditions due to their significantly lower power outputs.

For example, the present inventors have investigated water-wall arc lamps as an alternative to laser or weld cladding heads for use in a cladding process, whereby various types of coatings are fused to metal structures. The metal structures may include steel pipes, tubes, plates or bars, or any other metal structures whose durability and lifetime are adversely affected by corrosion or wear. The coatings may include corrosion resistant alloys, wear-resistant alloys, cermet, ceramic or metal powders, for example. The coating is deposited onto the metal structure and the arc lamp then heat-treats the coating to metallurgically bond the coating to the metal structure.

Some such cladding applications, such as bonding a corrosion-resistant coating to the inside surface of a pipe, for example, pose particular challenges. For such a process, a water-wall arc lamp may be fitted with a specialized reflector to direct substantially all of the electromagnetic radiation emitted by the arc in a rectangular beam. The water-wall arc lamp is then inserted inside the pipe with the beam pointing downward, and the pipe is rotated about its central axis while the arc lamp is gradually moved forward along the central axis of the pipe, thereby scanning the beam along the entire inner surface of the pipe and metallurgically bonding the coating to the pipe. Advantageously, by operating the water-wall arc lamp at power levels of 100 to 500 kilowatts continuously for several hours at a time, the throughput can be increased significantly beyond conventional laser or weld cladding processes.

However, the present inventors have found that previous water-wall arc lamp designs may not be ideally suited for such conditions. Early designs such as the illustrative embodiments disclosed in the above-noted U.S. Pat. Nos. 4,027,185, 4,700,102 and 4,937,490 do not have insulative housings surrounding their conductive electrode assemblies and are therefore unsuitable for insertion into small diameter metal pipes, due to the likelihood of voltage breakdown causing an arc to inadvertently form between one of the conductive electrode assemblies and the pipe rather than between the two electrodes. Later designs such as the illustrative embodiments disclosed in the above-noted U.S. Pat. Nos. 6,621,199 and 7,781,947 have insulative housings surrounding their cathode assemblies, and their anodes may be grounded or maintained relatively close to ground potential, so that such lamps may be inserted into a grounded conductive pipe without risk of voltage breakdown and inadvertent arcing. However, illustrative embodiments of both of these later designs may permit a relatively small percentage of electromagnetic radiation from the arc to travel internally within the arc lamp and strike an inner surface of the insulative housing.

Although arc radiation incident on an inner surface of the insulative housing does not tend to be problematic for conventional conditions involving shorter duration operation at high power levels or longer duration operation at lower power levels, novel problems may begin to arise for sustained continuous operation at hundreds of kilowatts for long durations. For example, as disclosed in U.S. Pat. No. 7,781,947, the insulative housing surrounding the cathode assembly may be made of ULTEM™ plastic, which is an amorphous thermoplastic polyetherimide (PEI) resin with excellent heat resistance and dielectric properties permitting it to standoff high voltages. However, despite the formidable heat-resistant properties of the ULTEM™ plastic, sustained exposure to even a very small percentage of the electromagnetic radiation emitted by the arc when operating at enormous power levels of several hundred kilowatts for longer durations, ranging from minutes to several hours of continuous operation for some cladding applications, for example, may eventually cause overheating of the plastic and melting of the exposed surface. Moreover, the plastic tends to be at least partially transparent to some wavelengths emitted by the arc, with the result that arc radiation can be absorbed deeper within the plastic causing internal heating and melting, and can also travel through the plastic and irradiate adjacent metal components, causing the metal components to become sufficiently hot to melt the surface of the plastic adjacent to the metal.

Such overheating problems can be aggravated by the environmental conditions involved in some cladding applications. For example, if the arc lamp is inserted inside an 8-inch diameter pipe to metallurgically bond a coating to the inside surface of the pipe, the limited space and clearance within the pipe tend to diminish the ability of the lamp to dissipate heat into its ambient environment. Moreover, the lamp may be heated by its environment, as the heated pipe may emit infrared radiation and may also heat the lamp through conduction and convection through the ambient atmosphere.

The present inventors have found that merely placing an opaque shield such as a ceramic layer directly on the inner surface of the ULTEM™ plastic is not in itself sufficient to solve these problems, as the shield tends to be sufficiently heated by the arc radiation to melt the adjacent surface of the plastic. The present inventors have also found that merely replacing the ULTEM™ plastic with a ceramic insulative housing is not in itself a viable solution to these problems. Although ceramic material is opaque to the arc radiation and has much higher heat-resistance than the ULTEM™ plastic, heating the inner exposed surface causes large thermal gradients and stresses in the ceramic material which tend to crack the ceramic material, and such cracks are particularly problematic for ceramic materials due to their relatively low fracture toughness. Thermal expansion differences of the ceramic material and ULTEM™ plastic may create stresses in the plastic that leads to fracture. Moreover, ceramic materials may be too brittle to bear the mechanical stresses that the insulative housing is expected to endure for some applications.

In accordance with an illustrative embodiment of the present disclosure, an apparatus for generating electromagnetic radiation includes an envelope, a vortex generator configured to generate a vortexing flow of liquid along an inside surface of the envelope, first and second electrodes within the envelope configured to generate a plasma arc therebetween, and an insulative housing associated surrounding at least a portion of an electrical connection to one of the electrodes. The apparatus further includes a shielding system configured to block electromagnetic radiation emitted by the arc to prevent the electromagnetic radiation from striking all inner surfaces of the insulative housing. The apparatus further includes a cooling system configured to cool the shielding system.

Advantageously, in such an embodiment, the shielding system prevents electromagnetic radiation emitted by the arc from striking the inner surfaces of the insulative housing, thereby preventing overheating and melting of the insulative housing by direct irradiance. Likewise, the shielding system also prevents internal arc radiation from travelling through the insulative housing and striking other adjacent components of the arc lamp, thereby preventing such other adjacent components from overheating and melting the adjacent surface of the insulative housing. By cooling the shielding system, overheating of the shielding system is avoided, thereby advantageously preventing components of the shielding system from overheating and melting adjacent surfaces of the insulative housing.

In accordance with another illustrative embodiment, an apparatus for generating electromagnetic radiation includes means for generating a vortexing flow of liquid along an inside surface of an envelope, and means for generating a plasma arc between first and second electrodes within the envelope. The apparatus further includes means for blocking electromagnetic radiation emitted by the arc to prevent the electromagnetic radiation from striking all inner surfaces of an insulative housing surrounding at least a portion of an electrical connection to one of the electrodes. The apparatus further includes means for cooling the means for blocking.

In accordance with another illustrative embodiment, a method of generating electromagnetic radiation includes generating a vortexing flow of liquid along an inside surface of an envelope, and generating a plasma arc between first and second electrodes within the envelope. The method further includes blocking electromagnetic radiation emitted by the arc with a shielding system to prevent the electromagnetic radiation from striking all inner surfaces of an insulative housing surrounding at least a portion of an electrical connection to one of the electrodes. The method further includes cooling the shielding system.

Blocking may include blocking the electromagnetic radiation with an opaque surface of an insulative shielding component of the shielding system. The insulative shielding component may include a ceramic shielding component.

Cooling may include exposing the opaque surface of the insulative shielding component to the vortexing flow of liquid.

Alternatively, or in addition, blocking may include blocking the electromagnetic radiation with an opaque portion of the envelope. The opaque portion of the envelope may include a portion of the envelope having an opaque coating on an inside surface thereof. Alternatively, the opaque portion of the envelope may be composed of opaque quartz. Cooling may include exposing the opaque portion of the envelope to the vortexing flow of liquid.

Alternatively, or in addition, blocking may include blocking the electromagnetic radiation with an opaque surface of a conductive shielding component of the shielding system. Cooling may include conductively cooling the conductive shielding component. Conductively cooling may include conducting heat energy between the conductive shielding component and a liquid cooled conductor.

Thus, in some embodiments, blocking may include blocking the electromagnetic radiation with an opaque surface of an insulative shielding component of the shielding system, an opaque portion of the envelope and an opaque surface of a conductive shielding component of the shielding system.

Blocking further may include blocking the electromagnetic radiation from striking an O-ring seal.

The method may further include sealing at least one component against the envelope with a heat-resistant O-ring seal.

The method may further include blocking the electromagnetic radiation emitted by the arc with a second shielding system to prevent the electromagnetic radiation from striking all inner surfaces of a second insulative housing surrounding at least a portion of the other one of the electrodes, and cooling the second shielding system.

Blocking may include blocking the electromagnetic radiation with a light-piping shielding component of the shielding system to prevent the electromagnetic radiation from axially exiting from an annular interior volume of the envelope. The light-piping shielding component may include an opaque washer abutting a distal end of the envelope. Cooling may include exposing the washer to the vortexing flow of liquid.

The method may further include heat-shielding at least some of an outer surface of the insulative housing with an external heat shield, and cooling the external heat shield.

Other aspects and features of illustrative embodiments will become apparent to those ordinarily skilled in the art upon review of the following description of such embodiments in conjunction with the accompanying figures.

BRIEF DESCRIPTION OF THE DRAWINGS

In drawings which illustrate embodiments of the present disclosure.

DETAILED DESCRIPTION

Figure 1:
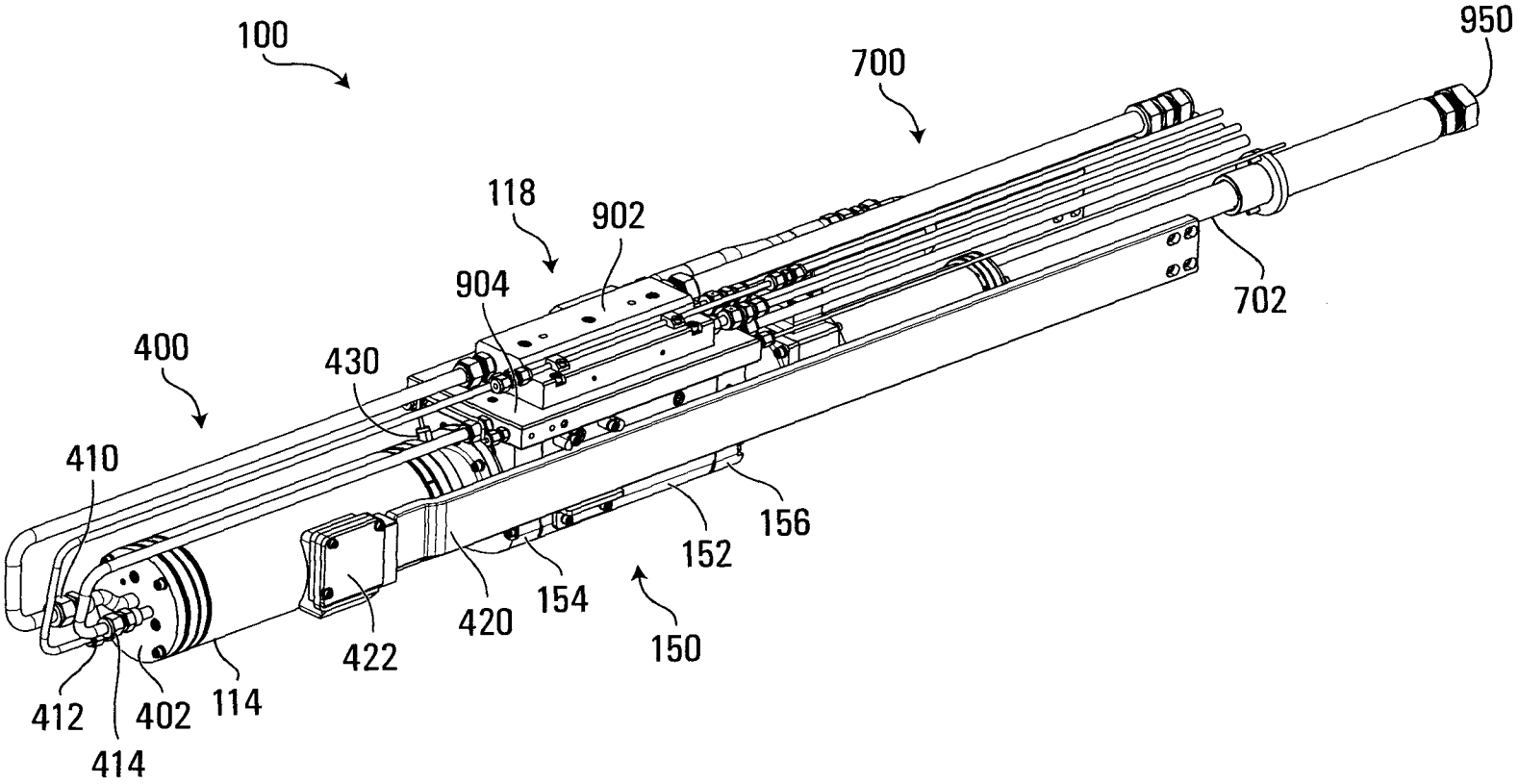
FIG. 1 is an isometric view of an apparatus for generating electromagnetic radiation according to a first embodiment.
Figure 2:
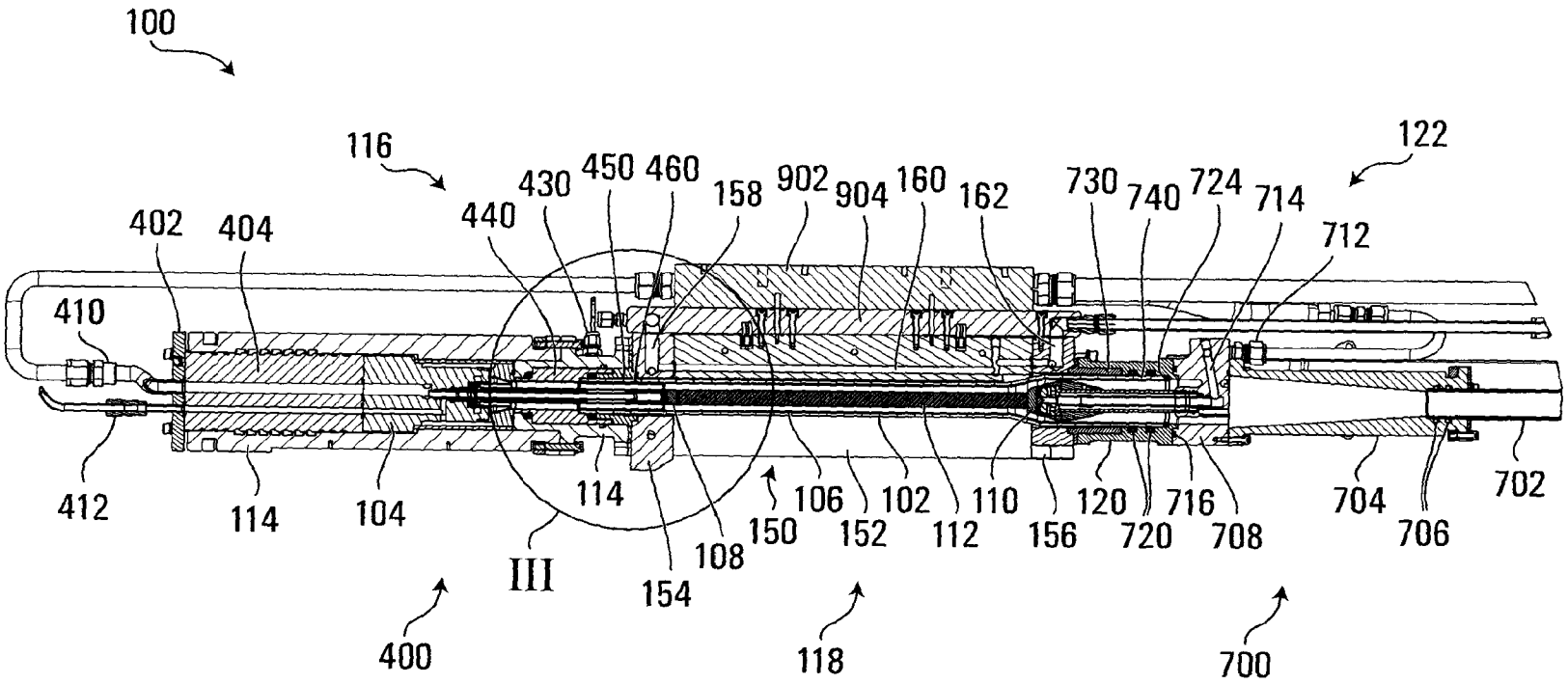
FIG. 2 is a section view of the apparatus of FIG. 1.
Figure 3:
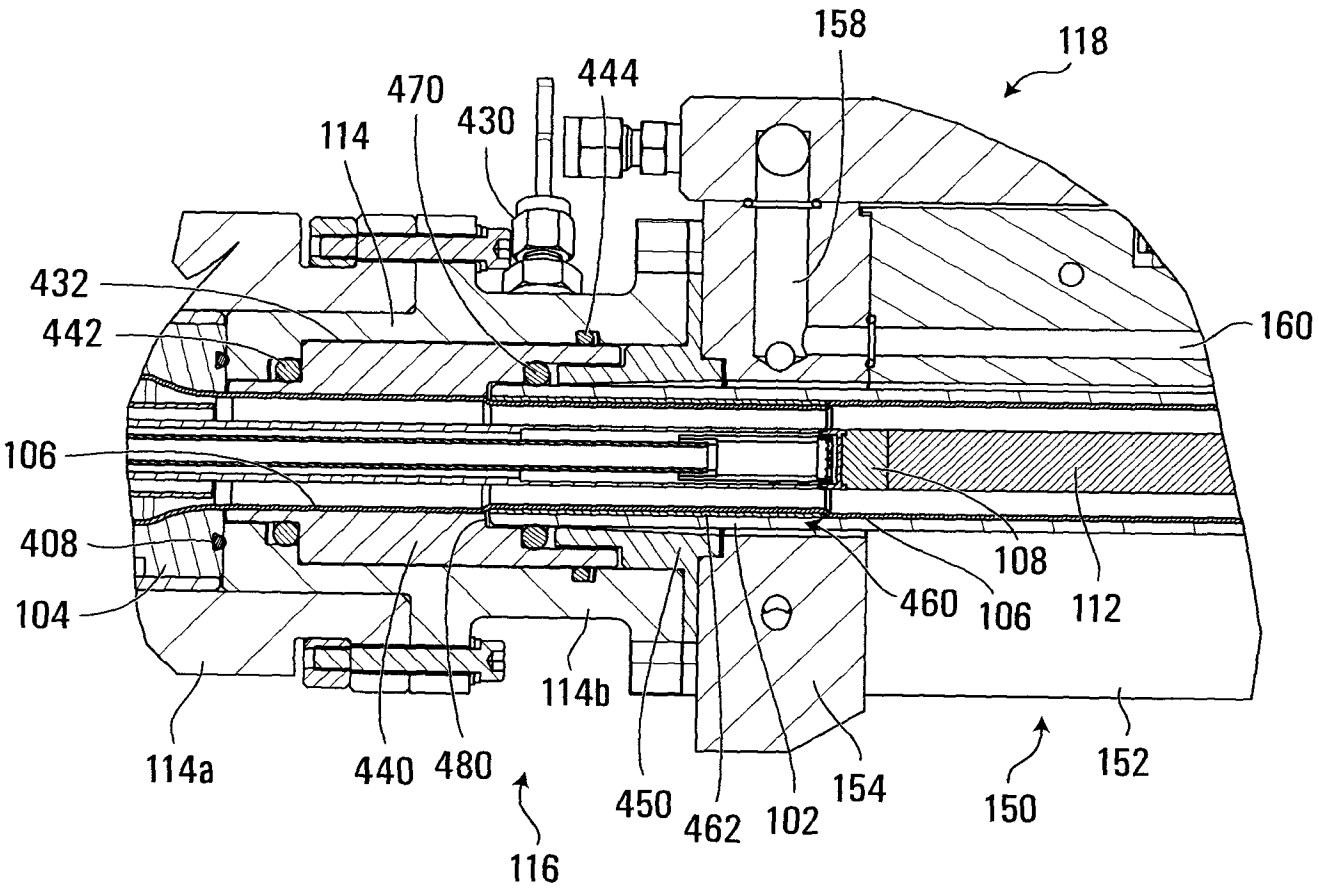
FIG. 3 is a detail section view of a portion of the apparatus of FIG. 1.

Referring to FIGS. 1, 2 and 3, an apparatus for generating electromagnetic radiation according to a first embodiment of the disclosure is shown generally at 100 in FIG. 2. In this embodiment, the apparatus 100 includes an envelope 102, and a vortex generator 104 configured to generate a vortexing flow of liquid 106 along an inside surface of the envelope 102. In this embodiment, the apparatus 100 further includes first and second electrodes 108 and 110 within the envelope 102 configured to generate a plasma arc 112 therebetween.

In the present embodiment, the apparatus 100 further includes an insulative housing 114 surrounding at least a portion of an electrical connection to one of the electrodes, which in this embodiment is the first electrode 108, and a shielding system shown generally at 116, configured to block electromagnetic radiation emitted by the arc 112 to prevent the electromagnetic radiation from striking all inner surfaces of the insulative housing 114. In this embodiment, the apparatus 100 further includes a cooling system shown generally at 118, configured to cool the shielding system 116.

In this embodiment, the apparatus further includes a second insulative housing 120 surrounding at least a portion of the other one of the electrodes, which in this embodiment is the second electrode 110, and a second shielding system 122 configured to block the electromagnetic radiation emitted by the arc to prevent the electromagnetic radiation from striking all inner surfaces of the second insulative housing. Also in this embodiment, the cooling system 118 is configured to cool the second shielding system 122.

The first and second shielding systems 116 and 122 and the cooling system 118 are described in greater detail below.

Generally, apart from the first and second shielding systems 116 and 122 and the complementary aspects of the cooling system 118 described in greater detail below, the apparatus 100 is similar to that described in the above-noted commonly owned U.S. Pat. No. 7,781,947. Accordingly, to avoid unnecessary repetition, numerous details of ancillary features of the present embodiment are omitted from the present disclosure.

Cathode Assembly and Cathode Side Shielding System

Figure 4:
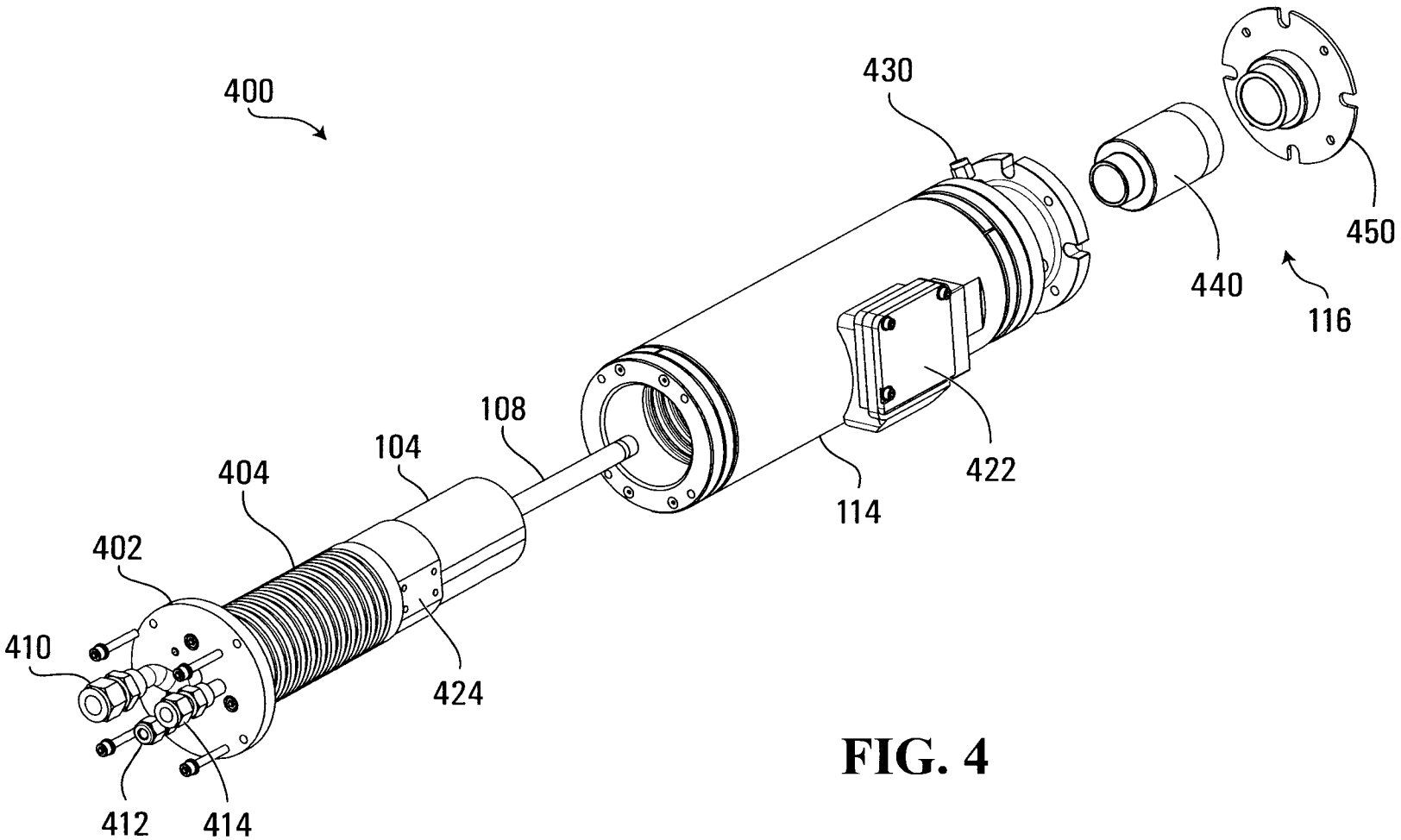
FIG. 4 is an exploded isometric view of a cathode assembly of the apparatus of FIG. 1.
Figure 5:
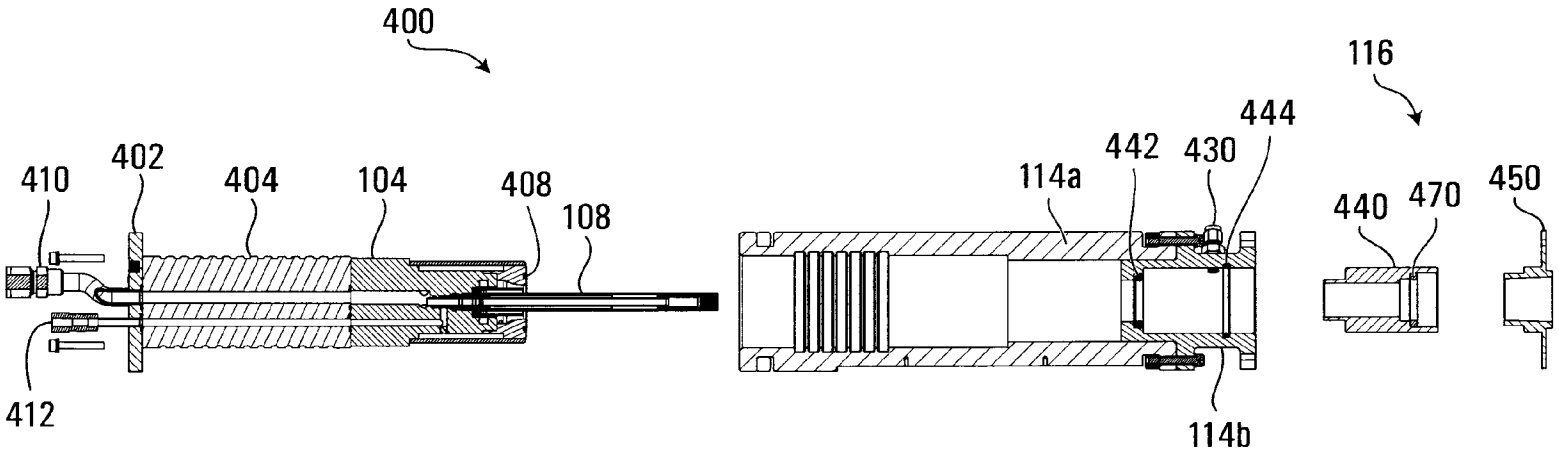
FIG. 5 is an exploded section view of the cathode assembly shown in FIG. 4.

Referring to FIGS. 1, 2, 3, 4 and 5, in this embodiment the apparatus 100 includes a cathode assembly shown generally at 400 in FIGS. 4 and 5. In this embodiment, the cathode assembly 400 includes a cathode supply plate 402 connected to a cathode isolation spacer 404, which in turn is connected to the vortex generator 104, which in turn is connected to the first electrode 108, which in this embodiment acts as a cathode.

In this embodiment, the cathode supply plate 402 includes a liquid coolant inlet port 410, a liquid coolant outlet port 412 and an inert gas supply inlet port 414. In the present embodiment, the liquid coolant inlet port 410 receives a pressurized supply of liquid coolant, which in this embodiment is deionized water, and supplies the liquid coolant to the vortex generator 104 and to the first electrode 108. Also in this embodiment, the liquid coolant outlet port 412 exhausts liquid coolant that has circulated through the interior of the first electrode 108. The circulation of the liquid coolant through the first electrode 108 is described in greater detail in the above-noted commonly owned U.S. Pat. No. 7,781,947, and therefore, further details are omitted herein. Finally, in this embodiment the inert gas supply inlet port 414 receives a pressurized supply of inert gas, which in this embodiment is argon, and supplies it to the vortex generator 104.

In this embodiment, the vortex generator 104 receives the pressurized supply of liquid coolant, which is then channeled through a plurality of internal holes within the vortex generator which exhaust the pressurized liquid into the envelope 102. More particularly, as the liquid is forced through the holes in the vortex generator, it acquires a velocity with components not only in the radial and axial directions relative to the envelope 102, but also a velocity component tangential to the circumference of the inside surface of the envelope 102. Thus, as the pressurized liquid exits the vortex generator 104 and enters the envelope 102, the liquid forms the vortexing flow of liquid 106 (also referred to as a "water wall") circling around the inside surface of the envelope 102 as it traverses the envelope in the axial direction toward the second electrode 110. Similarly, in this embodiment the vortex generator 104 also receives the pressurized supply of inert gas, which is channeled through a plurality of holes within the vortex generator 104 and is then exhausted into the envelope 102 slightly radially inward from the vortexing flow of liquid 106, so that the exiting gas also has velocity components not only in the radial and axial directions but also tangential to the inside surface of the water wall. Thus, as the pressurized gas is forced out of the vortex generator 104 and into the envelope 102, it forms a vortexing gas flow immediately radially inward from the vortexing flow of liquid 106, circling around in the same rotational direction as the vortexing flow of liquid 106. The structure of the vortex generator 104 and the holes therein to generate the vortexing flow of liquid 106 and the vortexing flow of gas contained therein are described in the above-noted commonly owned U.S. Pat. No. 7,781,947, and therefore, further details are omitted herein.

In this embodiment, the vortex generator 104 is an electrical conductor. More particularly, in this embodiment the vortex generator 104 is composed of brass, and forms a portion of the electrical connection to the first electrode 108, which in this embodiment acts as the cathode. More particularly, in this embodiment the electrical connection to the first electrode 108 includes an insulated electrical busbar 420 shown in FIG. 1, which is connected to an electrical connection surface 424 of the vortex generator 104 shown in FIG. 4, through an insulated bus connector 422 shown in FIGS. 1 and 4 which extends through the insulative housing 114. In this embodiment, the insulated bus connector 422 has a connection port which points toward the anode side of the apparatus 100, which facilitates a compact electrical connection with minimal outward radial protrusion. Thus, the insulated electrical busbar 420, the insulated bus connector 422 and the vortex generator 104 all form part of the electrical connection to the cathode.

Accordingly, during operation, the vortex generator 104 is at the same electrical potential as the first electrode 108. In this embodiment, the other end of the insulated electrical busbar 420 is connected with an electrical cable (not shown) to the negative voltage terminal of a power supply (not shown) for the apparatus 100, thereby connecting the first electrode 108 and the vortex generator 104 to the negative terminal of the power supply. The power supply may include a power supply similar to that disclosed in the above-noted U.S. Pat. No. 7,781,947, for example, optionally omitting components not required for the continuous operation of the present embodiment such as the dedicated capacitor banks for flash-lamp operation, for example. Alternatively, other suitable power supplies may be substituted. Thus, in this embodiment, the vortex generator 104 is at the same voltage as the negative terminal of the power supply and the cathode, which in this embodiment may include voltages as high as about −30 kilovolts at startup, and voltages up to −300 volts when running, relative to ground.

In this embodiment, the cathode isolation spacer 404 acts as a high-voltage standoff insulator, between the vortex generator 104 and the cathode supply plate 402, to prevent voltage breakdown and inadvertent arcing between the vortex generator 104 and the cathode supply plate 402. More particularly, in this embodiment the cathode isolation spacer 404 is composed of a thermoplastic, which in this embodiment is white DELRIN™ polyoxymethylene (POM).

Likewise, since the vortex generator 104 forms a portion of the electrical connection to the first electrode 108, in this embodiment the insulative housing 114 surrounds the vortex generator 104, and thus acts as a standoff insulative housing to prevent inadvertent voltage breakdown or arcing between the vortex generator 104 and any conductive objects in proximity to the apparatus 100. Indeed, in this embodiment the insulative housing 114 surrounds the entire vortex generator 104 and most of the first electrode 108. To the extent that the insulative housing 114 does not surround the axially innermost tip of the first electrode 108, the insulative housing 114 and the envelope 102 overlap in the axial direction, so that this innermost portion of the first electrode 108 is surrounded by the envelope 102. Thus, the entire high-voltage subassembly of the vortex generator 104 and the first electrode 108 is surrounded by the overlapping combination of the envelope 102 and the insulative housing 114. In this embodiment, the envelope 102 is composed of quartz, as discussed in greater detail below. Also in this embodiment, the insulative housing 114 is composed of an amorphous thermoplastic polyetherimide (PEI) resin, namely, ULTEM™ plastic, manufactured by SABIC (formerly by General Electric Plastics Division).

In this embodiment, the insulative housing 114 is fabricated from two separate pieces of ULTEM™, an axially outermost piece 114*a* and an axially innermost piece 114*b*, which are glued and bolted together, as shown in FIGS. 2, 3 and 5. When assembled, the vortex generator 104 is surrounded entirely by the axially outermost piece 114*a* of the insulative housing 114, and an axially inward-facing surface of the vortex generator 104 is sealed against an axially outward-facing surface of the axially innermost piece 114*b* of the insulative housing 114 with an O-ring 408, which in this embodiment is composed of silicone.

Referring to FIGS. 3-5, in this embodiment the insulative housing 114 further includes an insulative gas supply inlet port 430 for receiving pressurized insulative gas, which in this embodiment is nitrogen. The pressurized nitrogen fills a thin gap 432 shown in FIG. 3, defined between a radially inward-facing surface of the axially innermost piece of the two-piece insulative housing 114 and a radially outward-facing surface of an insulative shielding component 440 discussed below. The thin gap 432 is sealed by two O-rings 442 and 444, which in this embodiment are composed of silicone. The pressurized nitrogen gap increases the effective high voltage creepage distance, thereby enhancing the ability of the insulative housing 114 to standoff the high voltage of the first electrode 108 and prevent inadvertent voltage breakdown or arcing between the first electrode and conductive objects other than the second electrode 110 (notably including a copper conductive shielding component of the shielding system discussed below, but more generally including any other conductive objects in proximity to the electrode, whether internal or external to the apparatus 100).

Referring to FIGS. 2, 3, 4, 5 and 6, in this embodiment the cathode assembly 400 includes various components of the shielding system 116. In this embodiment, the shielding system 116 includes the insulative shielding component 440, which in this embodiment has an opaque surface configured to block electromagnetic radiation emitted by the plasma arc 112. More particularly, in this embodiment the insulative shielding component 440 is a ceramic shielding component, composed of opaque ceramic material, and therefore all of its surfaces are opaque. More particularly still, in this embodiment the insulative shielding component 440 is composed of MACOR™ machinable glass ceramic, manufactured by Corning.

Also in this embodiment, the shielding system 116 includes a conductive shielding component 450, which in this embodiment also has an opaque surface configured to block electromagnetic radiation emitted by the plasma arc 112. More particularly, in this embodiment the conductive shielding component 450 is composed of machined copper, and therefore, all of its surfaces are opaque.

Figure 6:
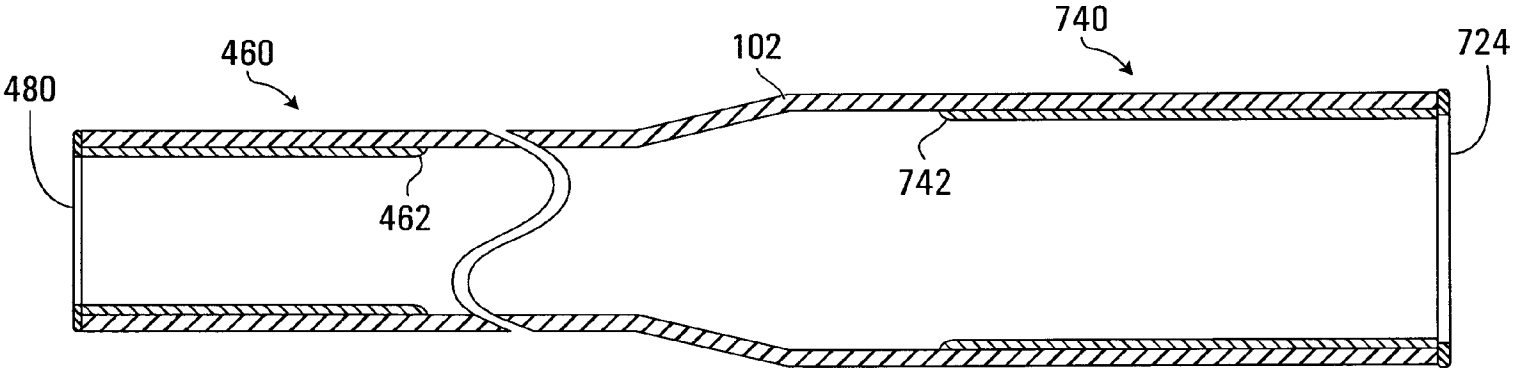
FIG. 6 is a segmented section view of an envelope of the apparatus of FIG. 1.

Referring to FIGS. 2, 3 and 6, in this embodiment the shielding system 116 includes an opaque portion 460 of the envelope 102 configured to block electromagnetic radiation emitted by the plasma arc 112. More particularly, in this embodiment the opaque portion 460 of the envelope 102 includes a portion of the envelope having an opaque coating 462 on an inside surface thereof. More particularly still, in this embodiment the envelope 102 is composed of HSQ 300 grade electrically fused quartz manufactured by Heraeus, and the opaque coating 462 is an HRC™ Heraeus Reflective Coating, which consists of a pure silica material having an open porous microstructure providing diffusive (near-Lambertian) reflectivity over a broad spectral range from ultraviolet to infrared, with high thermal stability. In this embodiment, the opaque coating 462 is applied over the axially outermost 70 mm of the inner surface of the envelope 102 at the cathode side. In this embodiment, the envelope 102 has a thickness of about 2.5 mm at the cathode side, and the opaque coating has a thickness of about 0.5 to 1 mm.

Thus, as shown in FIG. 3, the shielding system 116, or more particularly, the opaque surface of the insulative shielding component 440, the opaque portion 460 of the envelope 102 and the opaque surface of the conductive shielding component 450, block the electromagnetic radiation emitted by the arc 112 from striking all inner surfaces of the insulative housing 114.

Referring to FIGS. 3, 5 and 6, in this embodiment, the shielding system 116 is further configured to block the electromagnetic radiation emitted by the arc from striking an O-ring seal. In this regard, in the present embodiment, the cathode assembly 400 further includes a heat-resistant O-ring seal 470 configured to seal at least one component of the apparatus 100 against the envelope 102. More particularly, in this embodiment the heat-resistant O-ring seal 470 seals an outer surface of the opaque portion 460 of the envelope 102 against an inner surface of the insulative shielding component 440 of the shielding system 116. In this embodiment, the heat-resistant O-ring seal 470 is a KALREZ™ perfluoroelastomer O-ring seal manufactured by DuPont, and has greater heat resistance than the silicone O-rings 408, 442 and 444 used elsewhere in the cathode assembly 400. In this embodiment, the opaque portion 460 of the envelope 102, or more particularly the opaque coating 462, blocks electromagnetic radiation emitted by the plasma arc 112 from striking the heat-resistant O-ring seal 470.

Advantageously, since the opaque coating 462 is applied to the inside rather than the outside surface of the envelope 102, the opaque coating 462 does not interfere with the ability of the heat-resistant O-ring seal 470 to seal between the envelope 102 and the insulative shielding component 440.

Also in this embodiment, as shown in FIGS. 3 and 6, the shielding system 116 further includes a light-piping shielding component 480 configured to prevent electromagnetic radiation from axially exiting from an annular interior volume of the envelope. In this embodiment, the light-piping shielding component includes an opaque washer. More particular, in this embodiment the opaque washer includes a white reflective Teflon™ spacer interposed between an axially outward-facing cathode side end of the envelope 102 and an axially inward-facing abutment of the insulative shielding component 440. Alternatively, the light-piping shielding component 480 may be omitted.

In this embodiment the above-mentioned components of the shielding system 116, namely, the opaque surface of the insulative shielding component 440, the opaque portion 460 of the envelope 102, the opaque surface of the conductive shielding component 450 and the light-piping shielding component 480, are advantageously cooled by the cooling system 118, as discussed in greater detail below following a summary of the anode assembly and anode side shielding system.

Anode Assembly and Anode Side Shielding System

Figure 7:
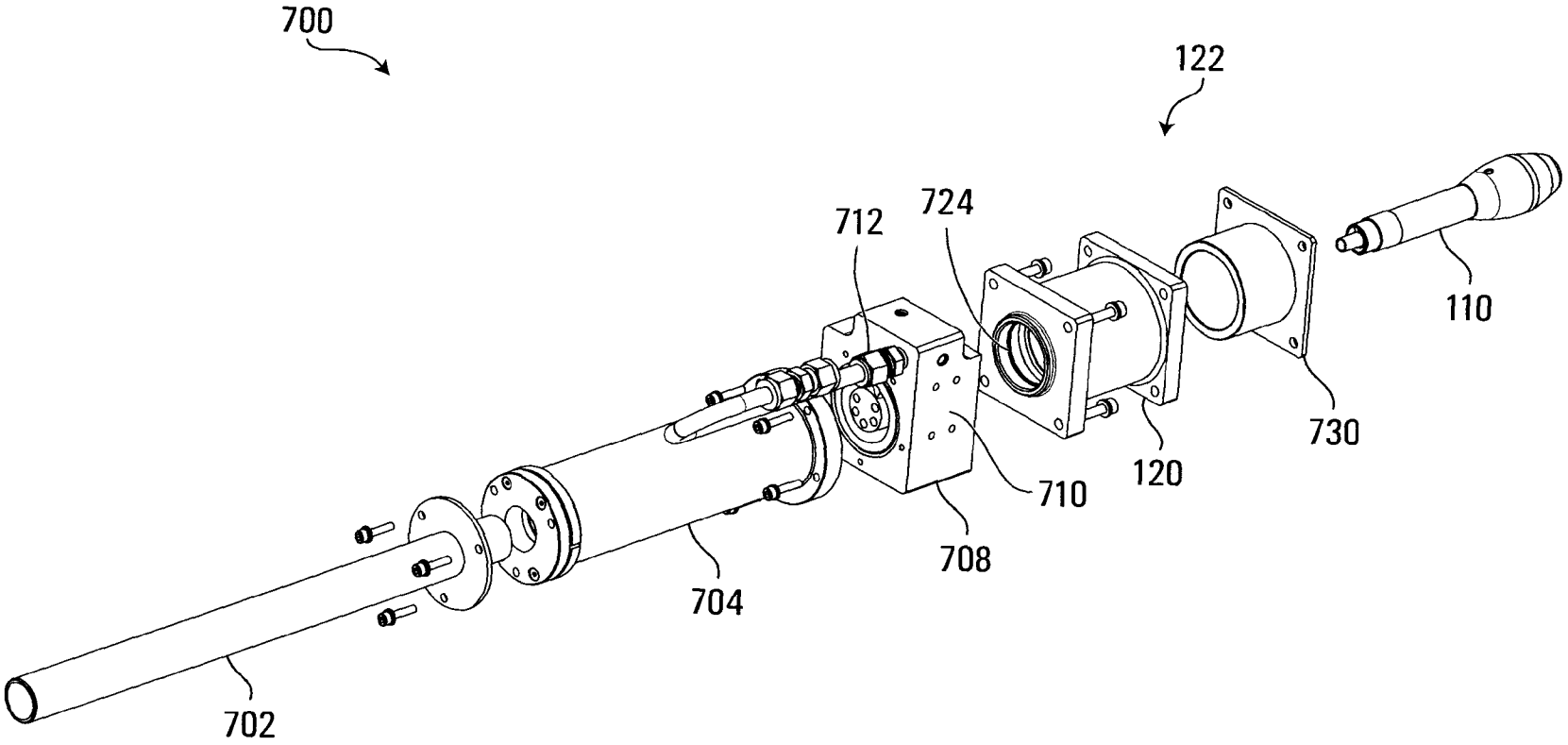
FIG. 7 is an exploded isometric view of an anode assembly of the apparatus of FIG. 1.
Figure 8:
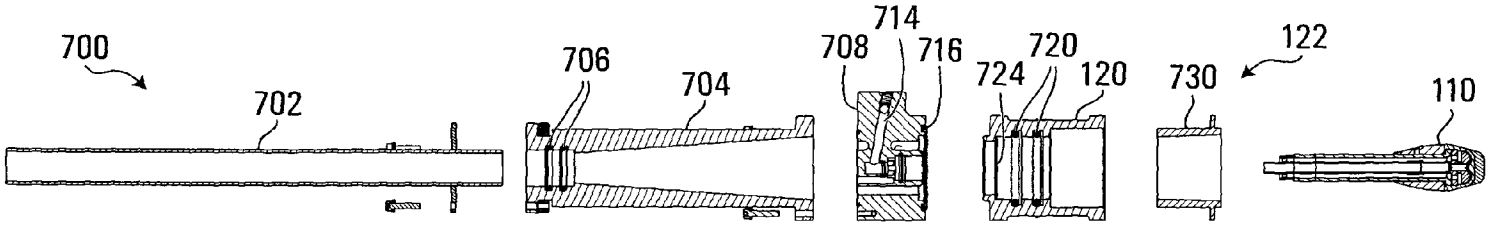
FIG. 8 is an exploded section view of the anode assembly shown in FIG. 6.

Referring to FIGS. 2, 7 and 8, in addition to shielding the insulative housing 114 at the cathode side of the apparatus 100 from arc radiation, in this embodiment similar shielding is provided at the anode side of the apparatus 100. Thus, as noted earlier herein, in this embodiment the apparatus 100 further includes the second insulative housing 120 surrounding at least a portion of the other one of the electrodes, which in this embodiment is the second electrode 110, which is configured to act as the anode. In this embodiment, the apparatus 100 further includes the second shielding system 122 configured to block the electromagnetic radiation emitted by the arc to prevent the electromagnetic radiation from striking all inner surfaces of the second insulative housing 120. Also in this embodiment, the cooling system 118 is configured to cool the second shielding system 122.

Referring to FIGS. 2, 7 and 8, in this embodiment an anode assembly of the apparatus 100 is shown generally at 700. In this embodiment, the anode assembly 700 includes a liquid and gas exhaust tube 702 and an exhaust chamber 704, through which the vortexing flow of liquid 106 and the vortexing flow of inert gas are exhausted from the apparatus 100. In this embodiment, the liquid and gas exhaust tube 702 is composed of stainless steel, and the exhaust chamber 704 is an insulative housing composed of high performance plastic, which in this embodiment is ULTEM™ plastic. In this embodiment, an axially innermost end of the liquid and gas exhaust tube 702 is inserted into and sealed against an axially outermost end of the exhaust chamber 704 by two O-rings 706 shown in FIG. 8, which in this embodiment are ethylene propylene diene monomer (EPDM) O-rings.

Referring to FIGS. 1, 2, 7 and 8, in this embodiment, the anode assembly 700 further includes an electrode housing 708, attached to and in electrical communication with the second electrode 110. In the present embodiment, the electrode housing 708 is a conductive housing composed of brass, and includes an electrical connection surface 710. In this embodiment, an insulated electrical busbar (not shown but similar to the busbar 420 shown in FIG. 1) is connected to the electrical connection surface 710 through an insulated bus connector (not shown but similar to the connector 422 shown in FIG. 1, and also having a connection port pointing toward the anode side of the apparatus 100 to facilitate compact electrical connection with minimal radial protrusion). The other end of the insulated electrical busbar is connected with an electrical cable (not shown) to a positive voltage terminal of the power supply (not shown) for the apparatus 100.

Accordingly, during operation, the electrode housing 708 is at the same electrical potential as the second electrode 110, and both are connected to the positive terminal of the power supply. In this embodiment, this positive terminal voltage may range up to +300 volts. Since the electrode housing 708 is exposed in the present embodiment, the apparatus 100 is structurally configured to maintain a minimum separation gap in excess of several millimeters between the electrode housing and a grounded cylindrical pipe in which the apparatus 100 may be inserted, so that the ambient atmosphere in the gap sufficiently insulates the electrode housing from the pipe against this modest electrical potential difference between the two structures. Alternatively, the positive terminal voltage may be grounded, as disclosed in the above-noted U.S. Pat. No. 7,781,947.

In this embodiment, the electrode housing 708 further includes a liquid coolant inlet 712 shown in FIG. 7, which receives liquid coolant from the cooling system 118. The liquid coolant is channeled into the second electrode 110 through a cooling channel 714 shown in FIG. 8, which directs the liquid coolant into the anode to cool it. The liquid coolant circulates through the second electrode 110 then exits the second electrode 110 into the exhaust chamber 704 and exhaust tube 702, through which it exits the apparatus 100 along with the liquid and gas exiting the envelope 102. The circulation of the coolant through the second electrode is described in the above-noted commonly owned U.S. Pat. No. 7,781,947, and therefore, further details are omitted herein.

Referring to FIGS. 2, 7 and 8, in this embodiment, the electrode housing 708 is connected to the second insulative housing 120, with an O-ring sealing the connection therebetween. In this embodiment, the O-ring 716 is a silicone O-ring.

In this embodiment, the apparatus 100 includes a heat-resistant O-ring seal configured to seal at least one component of the apparatus 100 against the envelope. More particularly, in this embodiment the second insulative housing 120 includes two heat-resistant O-ring seals 720, which in this embodiment are KALREZ™ perfluoroelastomer O-ring seals manufactured by DuPont, for sealing an inner surface of the second insulative housing 120 against an outer surface of the envelope 102.

Referring to FIGS. 2, 6, 7 and 8, in this embodiment the anode assembly 700 includes various components of the second shielding system 122. More particularly, in this embodiment the shielding system 122 includes a light-piping shielding component 724 configured to prevent the electromagnetic radiation from axially exiting from an annular interior volume of the envelope 102. More particularly still, in this embodiment the light-piping shielding component 724 includes an opaque washer abutting a distal end of the envelope. In this embodiment, the opaque washer is composed of brass. Thus, to the extent that some of the electromagnetic radiation emitted by the arc may travel axially outward within the annular interior volume of the envelope 102, the light-piping shielding component 724 blocks such radiation from axially exiting the distal end of the envelope 102, thereby preventing such radiation from striking or entering into the second insulative housing 120.

Similarly, in this embodiment the inner surfaces of the second insulative housing 120 are also shielded against arc radiation travelling radially outward, by two additional components of the shielding system 122 described below.

Referring to FIGS. 2, 7 and 8, in this embodiment the second shielding system 122 includes a conductive shielding component 730 having an opaque surface. More particularly, in this embodiment the conductive shielding component 730 includes a sleeve which is inserted into an axially innermost end of the second insulative housing 120. In this embodiment the sleeve is composed of copper, which is opaque, and therefore all of its surfaces are opaque.

Referring to FIGS. 2, 6, 7 and 8, in this embodiment the shielding system 122 further includes an opaque portion 740 of the envelope 102, as shown in FIG. 6. More particularly, in this embodiment the opaque portion 740 of the envelope includes a portion of the envelope having an opaque coating 742 on an inside surface thereof. In the present embodiment, the opaque coating 742 is an HRC™ Heraeus Reflective Coating, as described earlier in connection with the similar cathode side opaque coating 462. In this embodiment, the opaque coating 742 is applied over the axially outermost 80 mm of the inner surface of the envelope 102 at the anode side. In this embodiment, the envelope 102 has a thickness of about 3 mm at the anode side, and the opaque coating has a thickness of about 0.5 to 1 mm.

Referring to FIGS. 2, 6 and 8, in this embodiment the second shielding system 122 is further configured to block the electromagnetic radiation from striking an O-ring seal. More particularly, in this embodiment the opaque portion 740 of the envelope blocks the electromagnetic radiation emitted from the arc from striking the heat-resistant O-rings 720.

Thus, as shown in FIG. 2, in this embodiment the second shielding system 122, or more particularly, the light-piping shielding component 724, the opaque surface of the conductive shielding component 730 and the opaque portion 740 of the envelope 102, block the electromagnetic radiation emitted by the arc 112 from striking all inner surfaces of the second insulative housing 120. In the present embodiment, all three of these components of the shielding system 122 are advantageously cooled by the cooling system 118, as discussed below.

Reflector Assembly

Referring back to FIGS. 1, 2 and 3, in this embodiment the apparatus 100 includes a reflector assembly shown generally at 150. In this embodiment, the reflector assembly 150 includes a reflector 152. More particularly, in this embodiment the reflector 152 is an elliptical reflector, configured to direct electromagnetic radiation emitted by the plasma arc 112 through the envelope 102 through a rectangular opening (not shown) defined at the bottom of the reflector 152. In this embodiment, the reflector 152 has a polished copper body, and its elliptical reflective surface is a rhodium surface. More particularly, to form the reflective rhodium surface, the elliptical inner surface of the reflector 152 is coated first with electroless nickel then with high leveling bright nickel then with gold then with rhodium.

Referring to FIGS. 1, 2 and 3, in this embodiment, the reflector assembly 150 further includes a cathode assembly support plate 154 for connecting the reflector assembly 150 to the cathode assembly 400, and an anode assembly support plate 156 for connecting the reflector assembly 150 to the anode assembly 700. In this embodiment, the cathode assembly support plate 154 and the anode assembly support plate 156 are composed of copper.

Referring to FIGS. 2, 3 and 4, in this embodiment the cathode assembly support plate 154 abuts the conductive shielding component 450, and is secured to the cathode assembly 400 by a plurality of bolts which extend through the axially innermost piece **114*b* of the insulative housing, through the conductive shielding component 450, and into the body of the cathode assembly support plate 154**.

Similarly, referring to FIGS. 2 and 7, in this embodiment the anode assembly support plate 156 abuts the conductive shielding component 730, and is secured to the anode assembly 700 by a plurality of bolts which extend through the axially innermost end of the second insulative housing 120, through the conductive shielding component 730 and into the body of the anode assembly support plate 156.

In the present embodiment, the three main components of the reflector assembly 150, namely, the reflector 152, the cathode assembly support plate 154 and the anode assembly support plate 156, all have internal coolant channels such as those shown at 158, 160 and 162 for example, through which liquid coolant is directed, as discussed below.

Cooling System

Referring to FIGS. 1, 2, 3, 9 and 10, the cooling system is shown generally at 118 in FIG. 2. Generally, in this embodiment, the cooling system 118 cools the various components of the shielding system 116 and the second shielding system 122.

Figure 10:
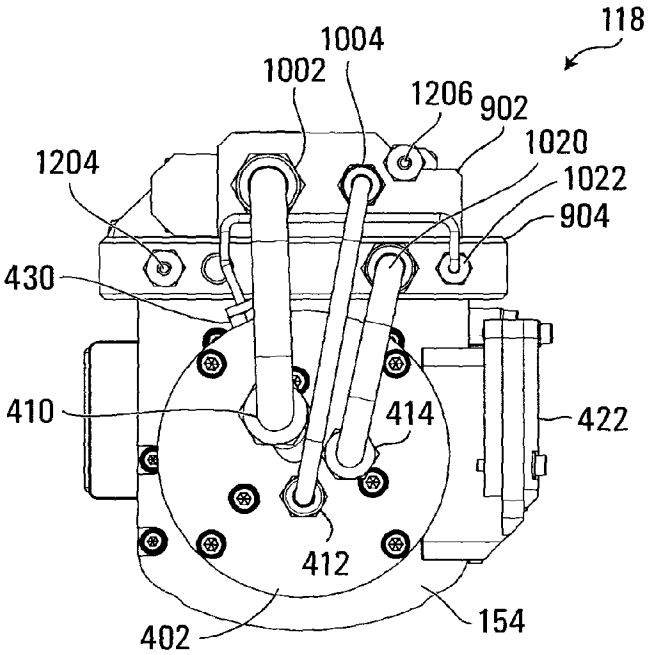
FIG. 10 is a cathode side elevation view of the apparatus of FIG. 1.
Figure 9:
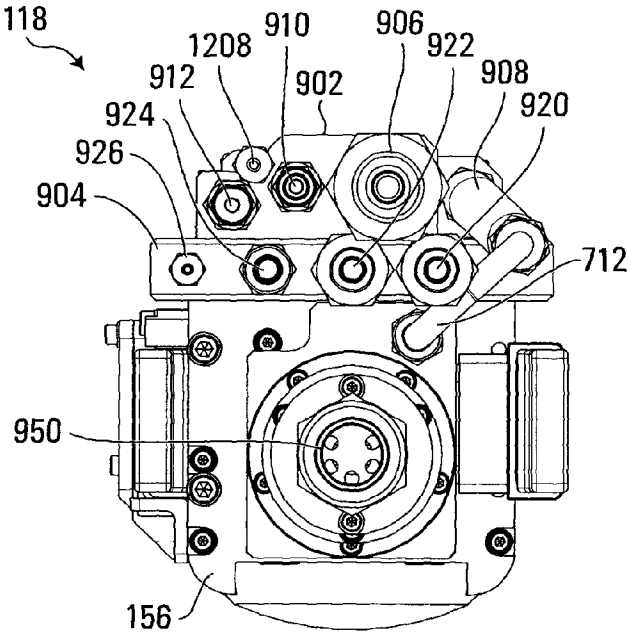
FIG. 9 is an anode side elevation view of the apparatus of FIG. 1.

In this embodiment, the cooling system 118 includes an upper manifold 902 and a lower manifold 904 shown in FIGS. 9 and 10. In the present embodiment, the lower manifold 904 is mounted on top of and attached to the reflector assembly 150, and the upper manifold 902 is mounted on top of and attached to the lower manifold 904.

In the present embodiment, the upper manifold 902 and lower manifold 904 are configured such that the anode side of the apparatus 100 is used for all external fluid connections to enable the apparatus 100 to receive supplies of liquids or gas from a fluid supply source system (not shown), and the cathode side of the apparatus is used only for fluid connections between different parts of the apparatus and not for external fluid connections. It will be recalled that the insulated bus connector 422 for the electrical connection to the cathode and the similar bus connector for electrical connection to the anode both have connection ports which point toward the anode side of the apparatus 100. Thus, this configuration of fluid connections and electrical connections advantageously results in a compact design of the apparatus 100, with all external connections being made from the anode side, which facilitates insertion of the apparatus 100 into cramped environments, such as the interior of an 8-inch diameter pipe for cladding applications, for example.

In this embodiment, the upper manifold 902 includes a main liquid coolant inlet port 906 at the anode side of the manifold, for receiving a liquid coolant from an external source (not shown). In this embodiment, the liquid coolant is de-ionized water. In the present embodiment, the upper manifold 902 divides the received flow of liquid coolant between a cathode supply outlet port 1002 at the cathode side of the upper manifold 902 and an anode supply outlet port 908 at the anode side of the upper manifold 902.

In this embodiment, the cathode supply outlet port 1002 directs the liquid coolant to the liquid coolant inlet port 410 at the cathode supply plate 402. As discussed earlier herein, in this embodiment the liquid coolant received at the liquid coolant inlet port 410 is supplied to the vortex generator 104 to generate the vortexing flow of liquid 106, and to the first electrode 108 to circulate through the electrode and cool it, as discussed earlier herein. The vortexing flow of liquid 106 exits the apparatus 100 through the exhaust chamber 704 and exhaust tube 702. The coolant supplied to the first electrode 108 circulates through the hot cathode then exits the cathode assembly 400 through the liquid coolant outlet port 412, then re-enters the upper manifold 902 at a liquid coolant return inlet port 1004 and travels through the upper manifold 902 to a coolant outlet port 910, through which the used coolant exits the apparatus 100.

In this embodiment, the anode supply outlet port 908 directs liquid coolant to the liquid coolant inlet 712 of the electrode housing 708 of the anode assembly 700. The liquid coolant received at the inlet 712 is circulated through the cooling channel 714 and through the second electrode 110, and is then exhausted through the exhaust chamber 704 and exhaust tube 702 along with the vortexing flows of liquid 106 and gas that have passed through the envelope 102, as discussed earlier herein.

In the present embodiment, the upper manifold 902 further includes a purge gas supply inlet 912, through which a pressurized purge gas is supplied to maintain a pressurized flow of inert gas around the outside of the envelope 102. In this embodiment, the pressurized purge gas is argon, and the upper manifold 902 directs the received purge gas through a plurality of holes (not shown) defined through the reflector 152 of the reflector assembly 150. For some applications, such a flow of purge gas may reduce the likelihood of external environmental particulate contamination of the outside surfaces of the envelope 102 and the reflector 152.

In this embodiment, the lower manifold 904 includes a reflector coolant supply inlet port 920, for receiving a pressurized flow of liquid coolant from an external source (not shown) and for supplying the liquid coolant to the reflector assembly 150. In this embodiment, the coolant is facility cooling water, and the lower manifold 904 directs the water received at the inlet port 920 through the reflector assembly 150. More particularly, in this embodiment the lower manifold 904 directs the received coolant to circulate through the internal cooling channels such as those shown at 158, 160 and 162, of the reflector 152, the cathode assembly support plate 154 and the anode assembly support plate 156.

In the present embodiment, the lower manifold 904 further includes a reflector coolant return outlet port 922. In this embodiment, when the pressurized liquid coolant has circulated through the internal cooling channels of the reflector assembly 150 as described above, the lower manifold 904 then directs the liquid coolant to exit the apparatus 100 through the reflector coolant return outlet port 922.

In this embodiment, the lower manifold 904 further includes a first inert gas supply inlet port 924, a second inert gas supply inlet port 926, a first inert gas supply outlet port 1020 and a second inert gas supply outlet port 1022.

In the present embodiment, the first inert gas supply inlet port 924 receives a pressurized supply of inert gas, which in this embodiment is argon. The pressurized argon exits the lower manifold 904 at the first inert gas supply outlet port 1020, which is connected to the inert gas supply inlet port 414. The inert gas supply inlet port 414 supplies the pressurized flow of argon to the vortex generator 104, to generate a vortexing flow of argon radially inward from the vortexing flow of liquid 106, as discussed earlier herein.

In this embodiment, the second inert gas supply inlet port 926 receives a pressurized supply of inert gas, which in this embodiment is nitrogen. The pressurized nitrogen exits the lower manifold 904 at the second inert gas supply outlet port 1022, which is connected to the insulative gas supply inlet port 430, to fill and pressurize the thin gap 432 shown in FIG. 3 between the insulative housing 114 and the insulative shielding component 440, as discussed above.

Referring to FIGS. 1 and 9, in this embodiment the cooling system 118 further includes a liquid and gas return outlet port 950, connected to and axially outward from the liquid and gas exhaust tube 702, through which the vortexing flow of liquid 106, its accompanying vortexing flow of inert gas, and coolant from the second electrode 110, exit the apparatus 100.

Referring to FIG. 2, in this embodiment the cooling system 118 also includes certain components of the cathode assembly 400, notably including the vortex generator 104, as well as certain components of the reflector assembly 150, notably including the cathode assembly support plate 154 and the anode assembly support plate 156, as discussed in greater detail below.

Operation

During operation, although most of the electromagnetic radiation emitted by the plasma arc 112 travels radially outward through the envelope 102 and exits the apparatus 100, a small percentage of the electromagnetic radiation emitted by the arc tends to travel axially outward within the apparatus 100, past the tips of the first and second electrodes 108 and 110, where it becomes incident upon internal components of the apparatus 100. Although this internal irradiance would not tend to be problematic for short durations at very high power levels, or for longer durations at lower power levels, such internal irradiance may have significant heating effects if the apparatus 100 is operated continuously at extreme power levels of hundreds of kilowatts for longer durations, ranging from minutes to several hours of continuous operation for some cladding applications, for example. Without the shielding and cooling of the present embodiment, such heating may be problematic for insulative components of the apparatus 100 such as the insulative housings 114 and 120, as discussed earlier herein.

Referring back to FIGS. 2, 3, 6, 9 and 10, as discussed earlier herein, in this embodiment the shielding system 116 is advantageously configured to block electromagnetic radiation emitted by the arc 112 to prevent the electromagnetic radiation from striking all inner surfaces of the insulative housing 114. More particularly, in this embodiment the opaque surface of the insulative shielding component 440, the opaque portion 460 of the envelope 102 and the opaque surface of the conductive shielding component 450, block the electromagnetic radiation emitted by the arc 112 from striking all inner surfaces of the insulative housing 114. Advantageously, therefore, in this embodiment the shielding system 116 prevents internal electromagnetic radiation within the apparatus 100 from striking the insulative housing 114, thereby preventing such radiation from being directly absorbed by the housing and melting it, and also preventing such internal radiation from travelling through the housing to overheat adjacent components of the apparatus which could then melt the adjacent surfaces of the housing.

However, in the absence of additional cooling of the shielding system, additional problems may arise. For example, if the internal arc radiation delivers too much heat energy to the inner opaque surface of the insulative shielding component 440, which in this embodiment is ceramic, the irradiated inner opaque surface may become much hotter than the body or bulk of the ceramic material, causing large thermal gradients and stresses in the ceramic material, which may crack then ultimately fracture the ceramic material. Similarly, if the arc radiation delivers too much heat energy to the inner surface of the conductive shielding component 450, which in this embodiment is copper, the entire mass of the conductive shielding component 450 may overheat, potentially melting the adjacent surface of the insulative housing 114. Finally, if the arc radiation delivers too much heat energy to the opaque portion 460 of the envelope 102, the opaque portion may eventually overheat and begin to emit significant amounts of infrared radiation. Advantageously, therefore, in this embodiment the cooling system 118 avoids these problems by cooling the shielding system 116.

In this embodiment, the cooling system 118 includes the vortex generator 104, and the vortex generator 104 is configured to expose the opaque surface of the insulative shielding component 440 to the vortexing flow of liquid 106. As shown in FIG. 3, the vortexing flow of liquid 106 is in direct contact with the radially innermost surface of the insulative shielding component 440. Due to the high volumetric flow rate of the vortexing flow of liquid 106, the vortexing flow of liquid 106 can remove heat energy from the opaque surface at a rate much faster than the rate at which heat energy can be delivered to the opaque surface by the internal arc radiation. Advantageously, the surface of the insulative shielding component that is exposed to the vortexing flow of liquid 106 is the same opaque surface that blocks the electromagnetic radiation emitted by the arc and prevents it from striking the inner surface of the insulative housing 114. Therefore, the same opaque surface that blocks and absorbs some of the internal arc radiation is cooled by the vortexing flow of liquid 106 which prevents overheating of the opaque surface. Accordingly, thermal gradients and thermal stresses within the insulative shielding component 440 are minimized, thereby avoiding the problems of potential cracking and fracturing of the ceramic material of the insulative shielding component 440 that may otherwise have arisen from differential heating of the opaque surface of the insulative shielding component relative to its bulk.

Still referring to FIG. 3, in this embodiment the vortex generator 104 is also configured to expose the opaque portion 460 of the envelope 102 and the light-piping shielding component 480 to the vortexing flow of liquid 106. Advantageously, therefore, despite its role in blocking electromagnetic radiation emitted by the arc, the opaque portion 460 of the envelope 102 and the light-piping shielding component 480 do not overheat and do not begin to excessively emit infrared radiation.

In this embodiment, unlike the opaque surface of the insulative shielding component 440 and the opaque portion 460 of the envelope 102, in this embodiment the conductive shielding component 450 is not in direct contact with the vortexing flow of liquid 106. Rather, in this embodiment, the cooling system 118 is configured to conductively cool the conductive shielding component 450.

In this regard, in the present embodiment, the cooling system 118 includes a liquid cooled conductor in conductive contact with the conductive shielding component 450. More particularly, in this embodiment the liquid cooled conductor is the cathode assembly support plate 154 of the reflector assembly 150. It will be recalled that in this embodiment, the cathode assembly support plate 154 has internal cooling channels such as that shown at 158, through which liquid coolant is circulated. As shown in FIG. 3, in this embodiment the conductive shielding component 450 is in direct conductive contact with the liquid cooled cathode assembly support plate 154. Accordingly, to the extent that internal arc radiation tends to heat the conductive shielding component 450, such heat energy is conducted into the cathode assembly support plate 154 and is then removed by the circulating flow of liquid coolant therethrough.

In this embodiment, components of the second shielding system 122 at the anode side of the apparatus 100 are similarly cooled by the cooling system 118.

For example, referring to FIGS. 2 and 6, in this embodiment the vortex generator 104 is configured to expose both the opaque portion 740 of the envelope 102 and the light-piping shielding component 724 to the vortexing flow of liquid 106, thereby cooling these two shielding components and preventing internal arc radiation from overheating them.

Referring to FIGS. 2 and 7, in this embodiment the cooling system 118 includes a liquid cooled conductor in conductive contact with the conductive shielding component 730. More particularly, in this embodiment the liquid cooled conductor is the anode assembly support plate 156 of the reflector assembly 150, which has internal cooling channels such as that shown at 162 through which liquid coolant is circulated. As shown in FIG. 2, in this embodiment the conductive shielding component 730 is in direct conductive contact with the liquid cooled anode assembly support plate 156. Accordingly, to the extent that internal arc radiation tends to heat the conductive shielding component 730, such heat energy is conducted into the anode assembly support plate 156 and is then removed by the circulating flow of liquid coolant therethrough.

Alternatives

Figure 11:
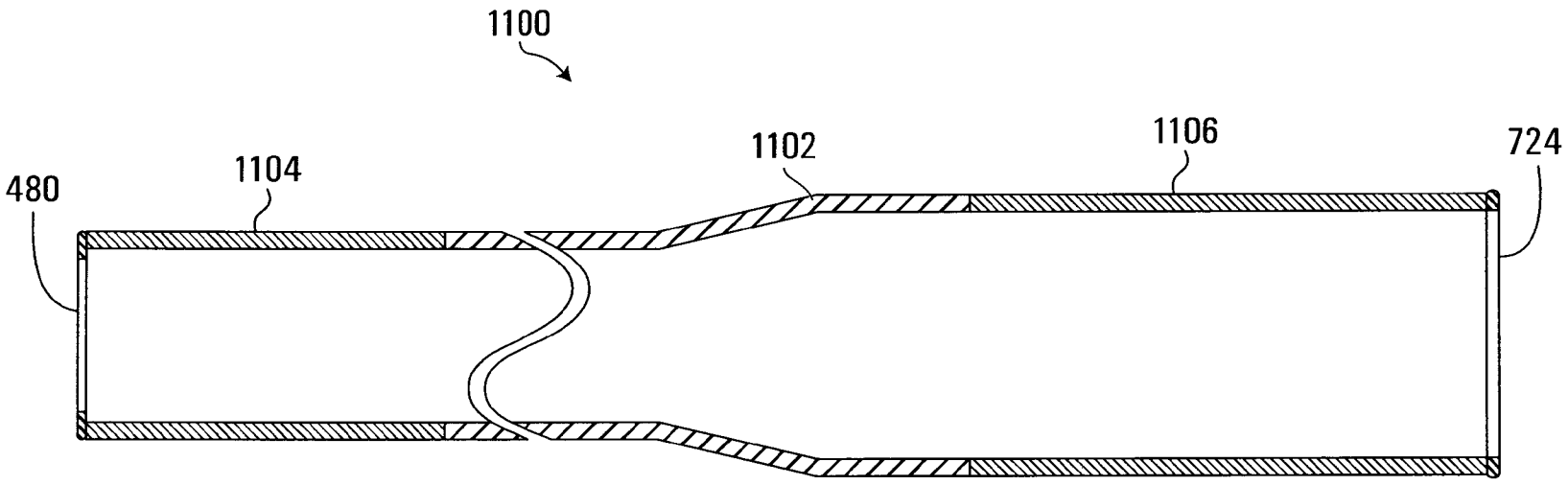
FIG. 11 is a segmented section view of an envelope of an apparatus for generating electromagnetic radiation according to a second embodiment.

Referring to FIGS. 2, 6 and 11, an envelope according to a second embodiment of the disclosure is shown generally at 1100 in FIG. 11. In this embodiment, the shielding system 116 and the shielding system 122 are modified by replacing the envelope 102 shown in FIG. 6 with the envelope 1100 shown in FIG. 11. In this embodiment, the shielding system 116 includes an opaque portion of the envelope 1100, namely, a cathode side opaque portion 1104, and similarly, the shielding system 122 includes another opaque portion of the envelope 1100, namely, an anode side opaque portion 1106.

In this embodiment, the envelope 1100 also includes a central portion 1102, which is composed of the same material as the envelope 102 shown in FIG. 6, namely, HSQ 300 grade electrically fused quartz manufactured by Heraeus.

However, in this embodiment the opaque portions 1104 and 1106 are composed of opaque quartz. More particularly, in this embodiment the opaque portions 1104 and 1106 are composed of OM 100 opaque quartz glass manufactured by Heraeus. This material includes small, irregularly shaped micron-sized pores which are evenly distributed in an amorphous opaque quartz matrix, resulting in efficient diffuse scattering of electromagnetic radiation. In this embodiment, the opaque portion 1104 consists of the axially outermost 55 mm of the envelope 1100 at the cathode side, and the opaque portion 1106 consists of the axially outermost 80 mm of the envelope 1100 at the anode side. In the present embodiment, as with the previous embodiment, the lengths of the opaque portions are selected to be sufficiently long to block internal arc radiation from striking internal shielding components as described above, but sufficiently short that they do not extend inwardly past the tips of the electrodes, thus avoiding any inadvertent blocking of radiation which would otherwise exit the apparatus 100 through the reflector assembly 150. In this embodiment, the central portion 1102 is joined to the opaque portions 1104 and 1106 by carefully melting them together while striving to maintain concentricity, surface smoothness and dimensional accuracy to the greatest extent possible.

In this embodiment, the opaque portions 1104 and 1106 are advantageously cooled by the cooling system 118, or more particularly by the vortexing flow of liquid 106 which is generated by the vortex generator 104 of the cooling system 118, in the same manner as the opaque portions 460 and 740 of the previous embodiment.

Figure 12:
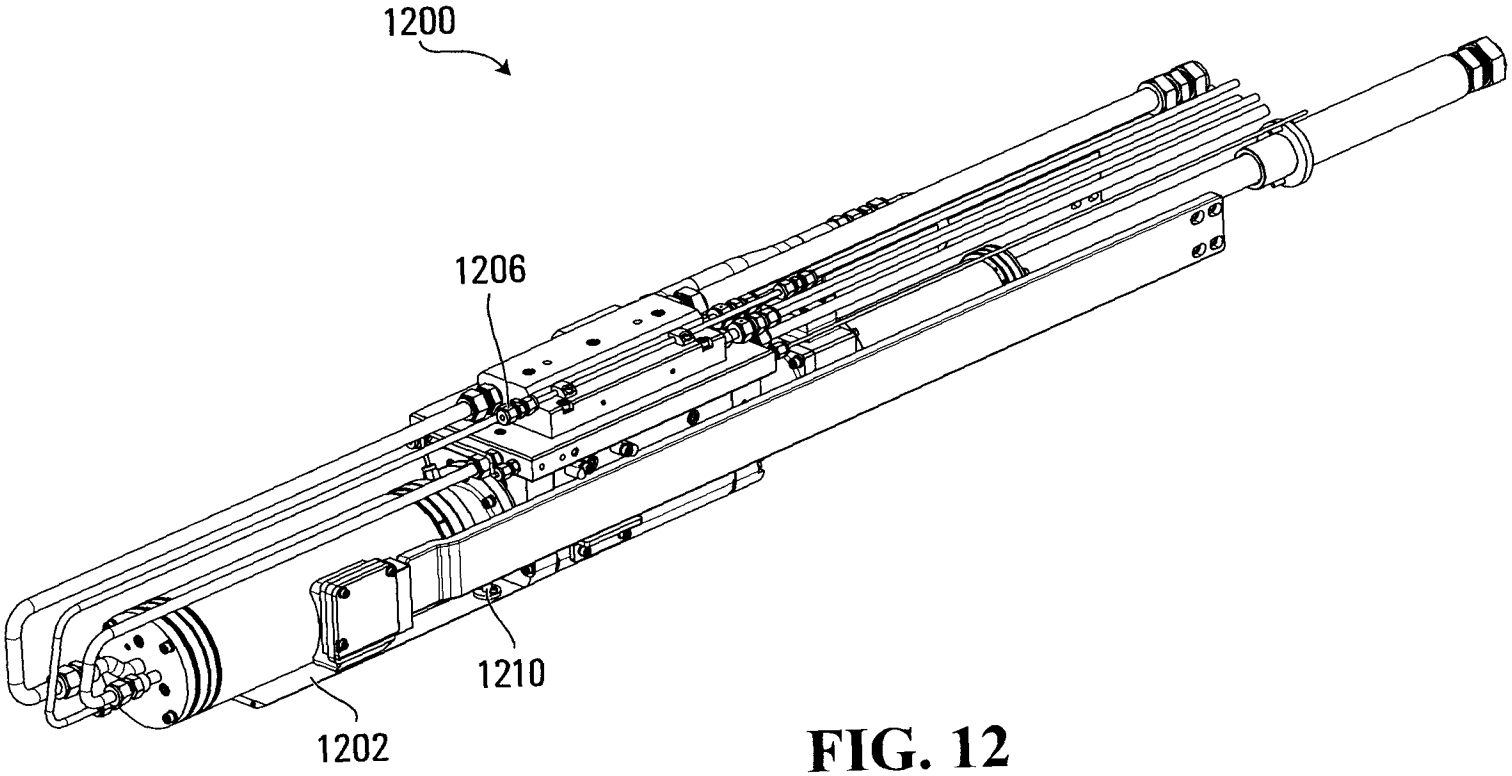
FIG. 12 is an isometric view of an apparatus for generating electromagnetic radiation according to a third embodiment.

Referring to FIGS. 1, 9, 10 and 12, an apparatus for generating electromagnetic radiation according to a third embodiment of the invention is shown generally at 1200 in FIG. 12. In this embodiment, the apparatus 1200 is identical to the apparatus 100 shown in FIG. 1, except in respect of the variations discussed below.

In this embodiment, the apparatus 1200 further includes an external heat shield 1202 configured to heat-shield at least some of an outer surface of the insulative housing 114, and the cooling system 118 is further configured to cool the external heat shield 1202.

In this embodiment, the external heat shield 1202 is a conductor. More particularly, in this embodiment the external heat shield 1202 is composed of anodized aluminum, and has liquid coolant channels (not shown) extending through its interior volume.

Referring to FIGS. 9 and 10, in this embodiment the lower manifold 904 of the cooling system further includes an external shield coolant supply outlet port 1204, and the upper manifold 902 further includes an external shield coolant return inlet port 1206 and an external shield coolant return outlet port 1208. The lower manifold receives a pressurized liquid coolant flow at the reflector coolant supply inlet port 920, and diverts a portion of the pressurized liquid coolant to the external shield coolant supply outlet port 1204, which is connected via a copper tube (not shown) to a coolant supply inlet port (not shown) of the external heat shield 1202. The liquid coolant circulates through the internal coolant channels inside the external heat shield 1202 then exits the external heat shield 1202 through a coolant return outlet port 1210 of the external heat shield 1202. The coolant return outlet port 1210 is connected via a copper tube (not shown) to the external shield coolant return inlet port 1206 of the upper manifold 902, through which the used liquid coolant flows through the upper manifold 902 then exits from the apparatus 1200 via the external shield coolant return outlet port 1208.

The liquid-cooled external heat shield 1202 may be advantageous for some particular applications. For example, if the apparatus 1200 is being used for cladding, to metallurgically bond a coating to the interior surface of a pipe, the apparatus 1200 may be inserted fully into the pipe with the cathode assembly 400 protruding from the far end of the pipe and the reflector assembly 150 aligned over the inner surface of the pipe at the far end. The coated pipe may then be rotated while the apparatus 1200 is gradually pulled longitudinally back through the pipe, so that the reflector 152 scans the electromagnetic radiation emitted by the arc across the interior surface of the pipe in a spiraling fashion. In such an application, the portion of the pipe presently facing the cathode assembly 400 tends to be hot, as that portion of the pipe was very recently exposed to the high-intensity electromagnetic radiation emitted from the reflector 152. Accordingly, the liquid cooled external heat shield 1202 shields the cathode assembly from heat transfer through conduction, convection and radiation which would otherwise occur in the ambient environment of the pipe. In this embodiment, the external heat shield 1202 also shields the exterior of the insulative housing 114 from electromagnetic radiation emitted by the arc that may be scattered or reflected by the pipe, and shields the cathode assembly 400 from debris coming from the heated pipe.

Alternatively, or in addition, a similar external heat shield (not shown) may be provided at the anode side of the apparatus 1200.

While specific embodiments have been described and illustrated, such embodiments should be considered illustrative only and not as limiting the invention as defined by the accompanying claims.

What is claimed is:

1. An apparatus for generating electromagnetic radiation, the apparatus comprising:

a) an envelope;

b) a vortex generator configured to generate a vortexing flow of liquid along an inside surface of the envelope;

c) first and second electrodes within the envelope configured to generate a plasma arc therebetween;

d) an insulative housing surrounding at least a portion of an electrical connection to one of the electrodes;

e) a shielding system configured to block electromagnetic radiation emitted by the arc to prevent the electromagnetic radiation from striking all inner surfaces of the insulative housing; and f) a cooling system configured to cool the shielding system.

2. The apparatus of claim 1 wherein the shielding system comprises an insulative shielding component having an opaque surface configured to block the electromagnetic radiation.

3. The apparatus of claim 2 wherein the insulative shielding component comprises a ceramic shielding component.

4. The apparatus of claim 2 wherein the cooling system comprises the vortex generator and wherein the vortex generator is configured to expose the opaque surface of the insulative shielding component to the vortexing flow of liquid.

5. The apparatus of claim 1 wherein the shielding system comprises an opaque portion of the envelope configured to block the electromagnetic radiation.

6. The apparatus of claim 5 wherein the opaque portion of the envelope comprises a portion of the envelope having an opaque coating on an inside surface thereof.

7. The apparatus of claim 5 wherein the opaque portion of the envelope is composed of opaque quartz.

8. The apparatus of claim 5 wherein the cooling system comprises the vortex generator and wherein the vortex generator is configured to expose the opaque portion of the envelope to the vortexing flow of liquid.

9. The apparatus of claim 1 wherein the shielding system comprises a conductive shielding component having an opaque surface configured to block the electromagnetic radiation.

10. The apparatus of claim 9 wherein the cooling system is configured to conductively cool the conductive shielding component.

11. The apparatus of claim 10 wherein the cooling system comprises a liquid cooled conductor in conductive contact with the conductive shielding component.

12. The apparatus of claim 1 wherein the shielding system is further configured to block the electromagnetic radiation from striking an O-ring seal.

13. The apparatus of claim 1 further comprising a heat-resistant O-ring seal configured to seal at least one component of the apparatus against the envelope.

14. The apparatus of claim 1 further comprising a second insulative housing surrounding at least a portion of the other one of the electrodes, and a second shielding system configured to block the electromagnetic radiation emitted by the arc to prevent the electromagnetic radiation from striking all inner surfaces of the second insulative housing, wherein the cooling system is configured to cool the second shielding system.

15. The apparatus of claim 1 wherein the shielding system further comprises a light-piping shielding component configured to prevent the electromagnetic radiation from axially exiting from an annular interior volume of the envelope.

16. The apparatus of claim 15 wherein the light-piping shielding component comprises an opaque washer abutting a distal end of the envelope.

17. The apparatus of claim 15 wherein the cooling system comprises the vortex generator and wherein the vortex generator is configured to expose the light-piping shielding component to the vortexing flow of liquid.

18. The apparatus of claim 1, further comprising an external heat shield configured to heat-shield at least some of an outer surface of the insulative housing, wherein the cooling system is further configured to cool the external heat shield.

19. An apparatus for generating electromagnetic radiation, the apparatus comprising:

a) means for generating a vortexing flow of liquid along an inside surface of an envelope;

b) means for generating a plasma arc between first and second electrodes within the envelope;

c) means for blocking electromagnetic radiation emitted by the arc to prevent the electromagnetic radiation from striking all inner surfaces of an insulative housing surrounding at least a portion of an electrical connection to one of the electrodes; and d) means for cooling the means for blocking.

20. A method of generating electromagnetic radiation, the method comprising:

a) generating a vortexing flow of liquid along an inside surface of an envelope;

b) generating a plasma arc between first and second electrodes within the envelope;

c) blocking electromagnetic radiation emitted by the arc with a shielding system to prevent the electromagnetic radiation from striking all inner surfaces of an insulative housing surrounding at least a portion of an electrical connection to one of the electrodes; and d) cooling the shielding system.

21. The method of claim 20 wherein blocking comprises blocking the electromagnetic radiation with an opaque surface of an insulative shielding component of the shielding system.

22. The method of claim 21 wherein the insulative shielding component comprises a ceramic shielding component.

23. The method of claim 21 wherein cooling comprises exposing the opaque surface of the insulative shielding component to the vortexing flow of liquid.

24. The method of claim 20 wherein blocking comprises blocking the electromagnetic radiation with an opaque portion of the envelope.

25. The method of claim 24 wherein the opaque portion of the envelope comprises a portion of the envelope having an opaque coating on an inside surface thereof.

26. The method of claim 24 wherein the opaque portion of the envelope is composed of opaque quartz.

27. The method of claim 24 wherein cooling comprises exposing the opaque portion of the envelope to the vortexing flow of liquid.

28. The method of claim 20 wherein blocking comprises blocking the electromagnetic radiation with an opaque surface of a conductive shielding component of the shielding system.

29. The method of claim 28 wherein cooling comprises conductively cooling the conductive shielding component.

30. The method of claim 29 wherein conductively cooling comprises conducting heat energy between the conductive shielding component and a liquid cooled conductor.

31. The method of claim 20 wherein blocking further comprises blocking the electromagnetic radiation from striking an O-ring seal.

32. The method of claim 20 further comprising sealing at least one component against the envelope with a heat-resistant O-ring seal.

33. The method of claim 20 further comprising blocking the electromagnetic radiation emitted by the arc with a second shielding system to prevent the electromagnetic radiation from striking all inner surfaces of a second insulative housing surrounding at least a portion of the other one of the electrodes, and cooling the second shielding system.

34. The method of claim 20 wherein blocking further comprises blocking the electromagnetic radiation with a light-piping shielding component of the shielding system to prevent the electromagnetic radiation from axially exiting from an annular interior volume of the envelope.

35. The method of claim 34 wherein the light-piping shielding component comprises an opaque washer abutting a distal end of the envelope.

36. The method of claim 34 wherein cooling comprises exposing the light-piping shielding component to the vortexing flow of liquid.

37. The method of claim 20 further comprising heat-shielding at least some of an outer surface of the insulative housing with an external heat shield, and cooling the external heat shield.

* * * * *